US005322010A

United States Patent [19]

Zimmer

[11] Patent Number: 5,322,010

[45] Date of Patent: Jun. 21, 1994

[54] SQUEEGEE DEVICE

[76] Inventor: Johannes Zimmer, Ebentalerstrasse 133, A-9020 Klagenfurt, Austria

[21] Appl. No.: 549,599

[22] Filed: Aug. 13, 1990

Related U.S. Application Data

[62] Division of Ser. No. 212,315, Jun. 27, 1988, Pat. No. 4,974,509.

[30] Foreign Application Priority Data

Jun. 30, 1987 [DE] Fed. Rep. of Germany ... 8709028[U]
Jun. 30, 1987 [DE] Fed. Rep. of Germany ... 8709029[U]

[51] Int. Cl.[5] ..... B41L 13/00

[52] U.S. Cl. ..... 101/120; 101/127; 101/127.1; 118/262

[58] Field of Search ..... 101/119, 120, 121, 124, 101/127.1, 127; 118/262, 213

[56] References Cited

U.S. PATENT DOCUMENTS 3,988,986 11/1976 Zimmer ..... 101/119
4,216,716 8/1980 Zimmer ..... 101/120

*Primary Examiner*—Edgar S. Burr
*Assistant Examiner*—Lynn D. Hendrickson

[57] ABSTRACT

A squeegee device for applying a substance to a web of material, comprising lateral boundary plates for the squeegee slidably guided in a direction normal to the web, the boundary plates being provided with inserts of magnetizable material, which can be attracted by a magnet arranged beneath the web of material.

2 Claims, 3 Drawing Sheets

SQUEEGEE DEVICE

Figure 1:
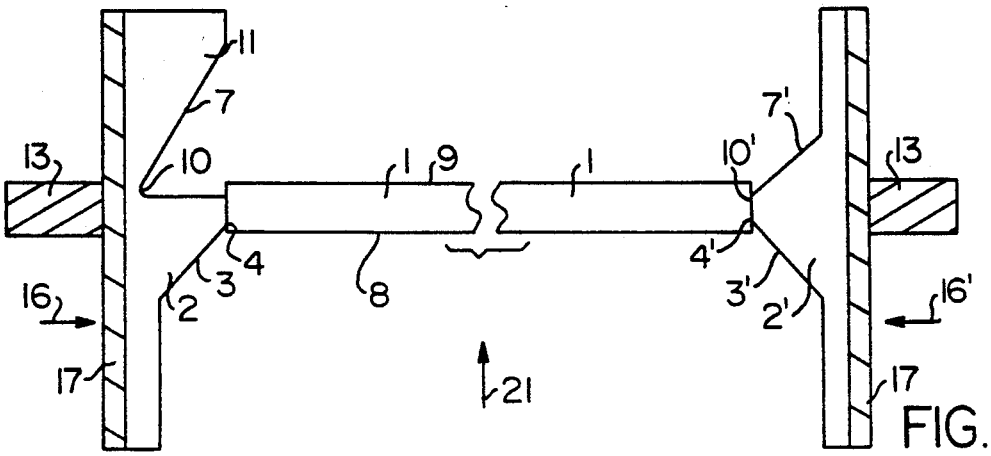

This is a divisional of copending application Ser. No. 07/212,315 filed on Jun. 27, 1988 now patented, U.S. Pat. No. 4,974,509.

The invention relates to a squeegee device for applying a substance to a web of material comprising a magnetically attracted squeegee roller, a bar along which the roller extends, further comprising lateral guide members for the roller.

By virtue of the fact that the squeegee roller is fitted into the stencil loosely and without support and due to the round stencil occasionally taking up an inclined position relative to the direction of movement, due to operating conditions, the squeegee roller occasionally is not disposed at a right angle relative to the direction of rotation and that, caused by rolling and pressing effects, gives rise to malfunctioning due to the roller moving off laterally. When that happens, a considerable thrust force is applied in the axial direction of the roller, and, particularly in the case of long rollers, that force has the result that contact blocks which are provided for centering of the roller bore into the contact surfaces, which are disposed at a right angle to the axis of the roller, on guide members of that kind, and damage the guide members.

A disclosed apparatus of the kind briefly set forth above (see Austrian patent specification No. 347 388) was intended to eliminate the above-mentioned difficulties. In actual fact however that proposal has not been adopted in practice because although the lateral guide members provided in that apparatus solved the problem regarding the way in which inclined positioning of the roller, which happens by chance, can be corrected again, it was however not possible to prevent application material from passing over into the region behind the roller in such an apparatus. The provision of a rigid bar between the guide members of the known apparatus would not solve that problem as, when the roller is in an inclined position relative to such a per se known support bar, the roller would lift away therefrom.

The aim of the invention is to provide an apparatus of the kind set forth in the opening part of this specification, in which application material is reliably prevented from passing into the region behind the roller.

In accordance with the invention that problem is solved by a resilient bar, whereby the bar which extends inbetween the guide members is resiliently deformable in a plane parallel to said web and in a plane normal to said web and to said roller, and whereby the bar is shorter than said roller.

The term "resilient" in accordance with the invention is used to denote a bar which is sufficiently twistable to bear against the roller over the entire length thereof when an angle occurs between the bar and the roller. Preferably the guide members comprise vertical contact surfaces for the roller, which are inclined relative to the axis of the roller, the bar extending partly between those contact surfaces, at least in its unbent state.

It has already been proposed that a roller for the surface treatment of webs of material may be disposed selectively in front of a bar which extends transversely with respect to the web of material, or behind same. In the latter case the bar retains a supply of substance and thereby prevents application material from passing into the region behind the roller. The invention may be of such a configuration that, when the roller is arranged in that fashion, accidental inclined positioning of the roller is also corrected again, with the sealing bar retaining its function. That is achieved in that contact surfaces for the roller are provided, both when the roller is arranged in front and behind the bar. In that case the bar also projects into the space between the rear contact surfaces.

When applying substances to a web of material, for example in a round or flat stencil printing operation using roller or scraper-type squeegees, there is the need for the substance which is accumulated in front of the applicator device to be limited laterally to that region in which the web of material is to be coated or is to receive printing. When the lateral boundary plates are rigidly connected to the pipe which usually extends transversely with respect to the web of material and which serves to provide the feed of substance to be applied, it is difficult for the boundary plates to be lowered on to the stencil or the web of material in such a way that on the one hand there is no gap but on the other hand there is not an excessive pressure. Therefore, various constructions are already to be found on the market, in which the lateral boundary plates are vertically displaceable relative to an ink pipe.

A disadvantage in the known constructions is the fact that therein the boundary plates at best lie loosely on the web of material or stencil. The provision of additional weights on the boundary plates would not only cause them to be difficult to move in their guide arrangement but in particular would also mean that the part of the applicator device which is connected to the ink pipe becomes unnecessarily heavy, which has an unacceptable effect in particular when introducing it into a round stencil and removing it therefrom.

The problem of the invention is to provide a possible way of pressing the boundary plates of an applicator device against the subjacent structure with a selectable force. In accordance with the invention that problem is solved in that the boundary plates are provided with inserts of magnetisable material, which can be attracted by a magnet arranged in per se known manner beneath the web of material.

Figure 2:
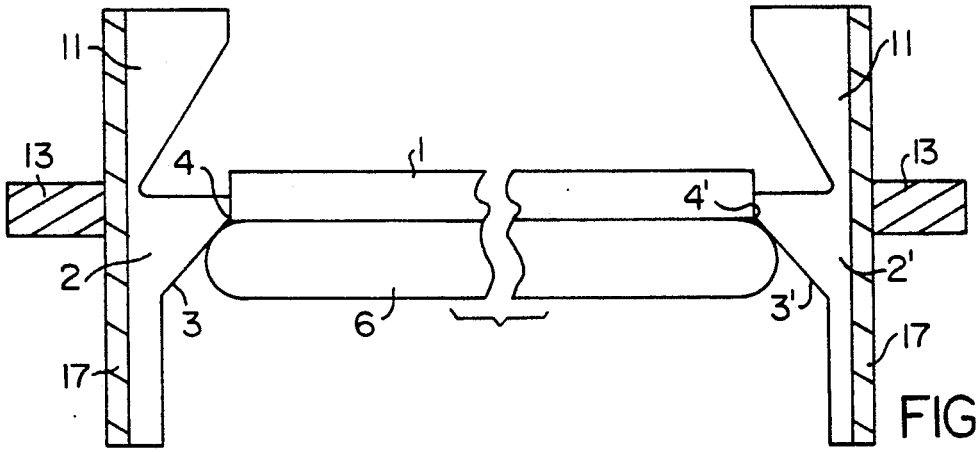
Figure 3:
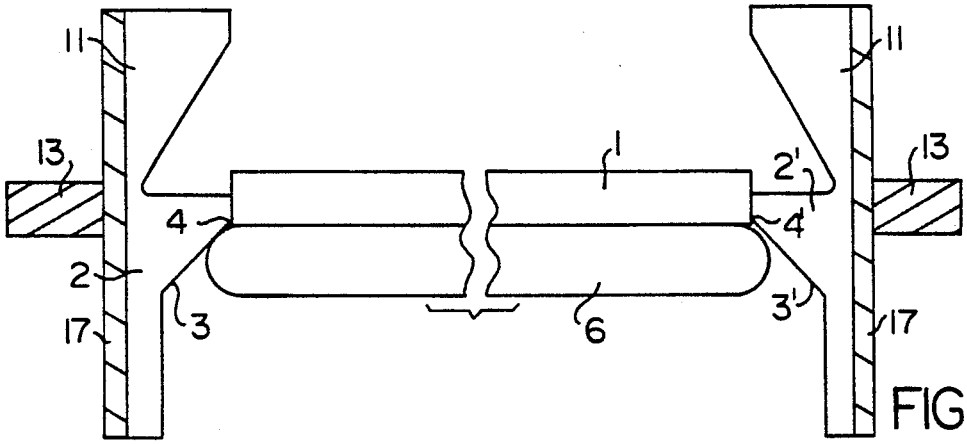
Figure 5:
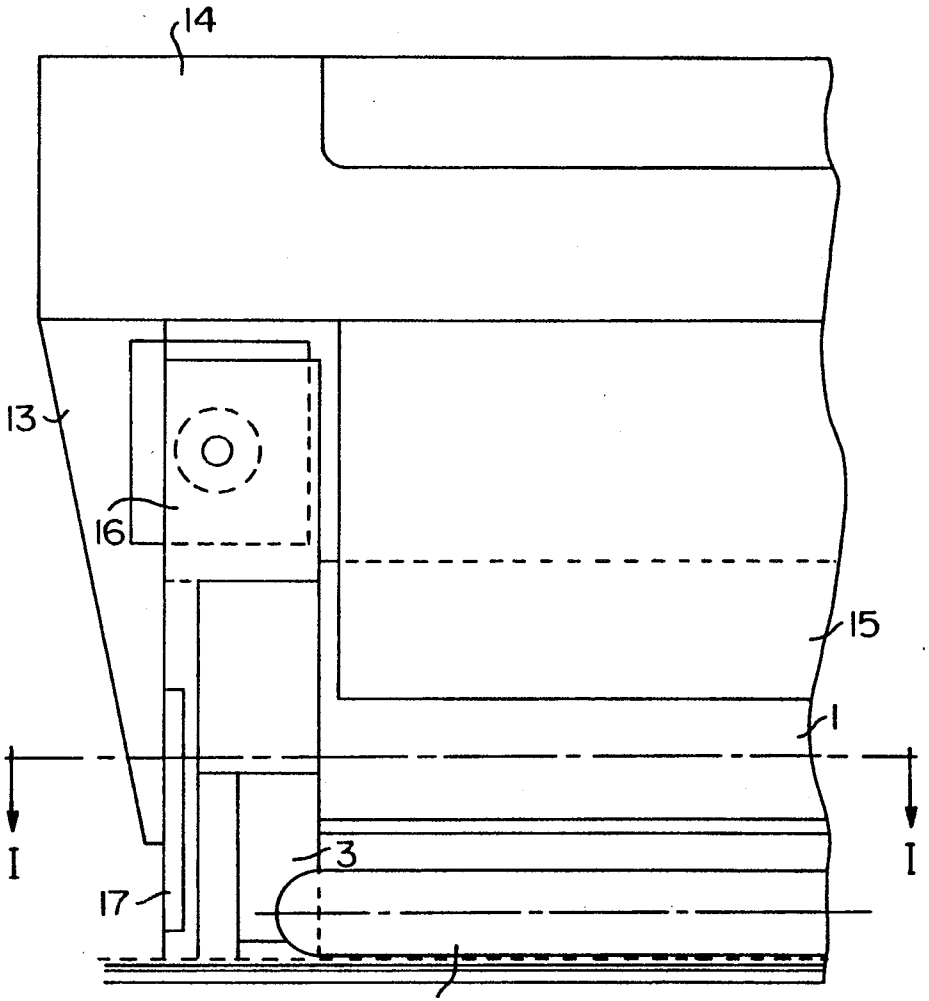
Figure 4:
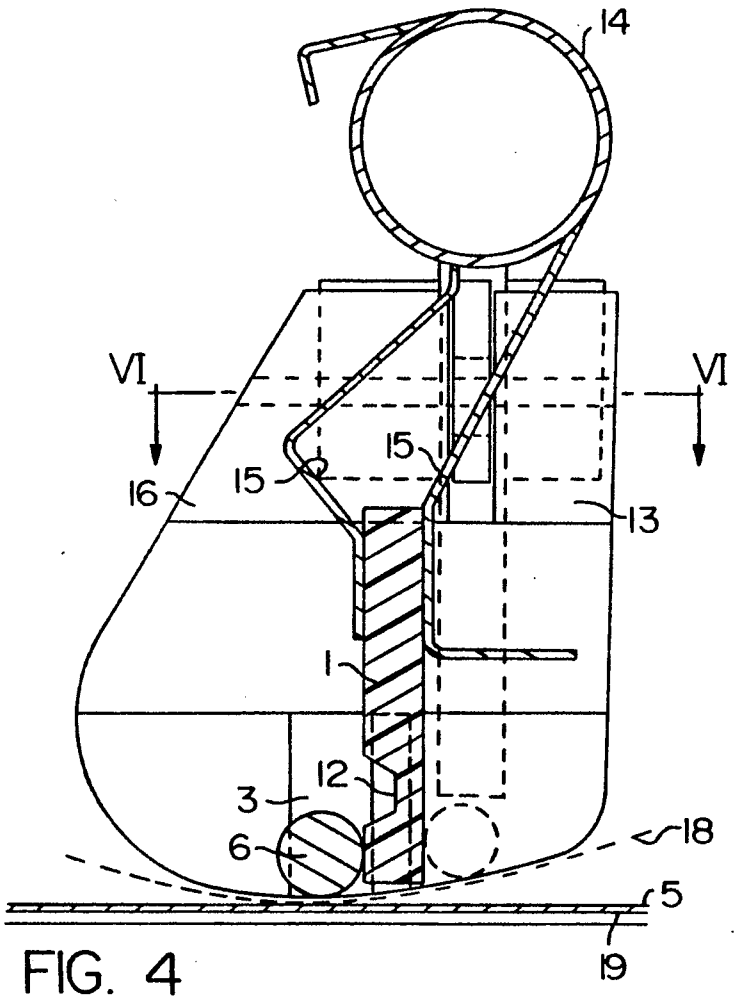
Figure 7:
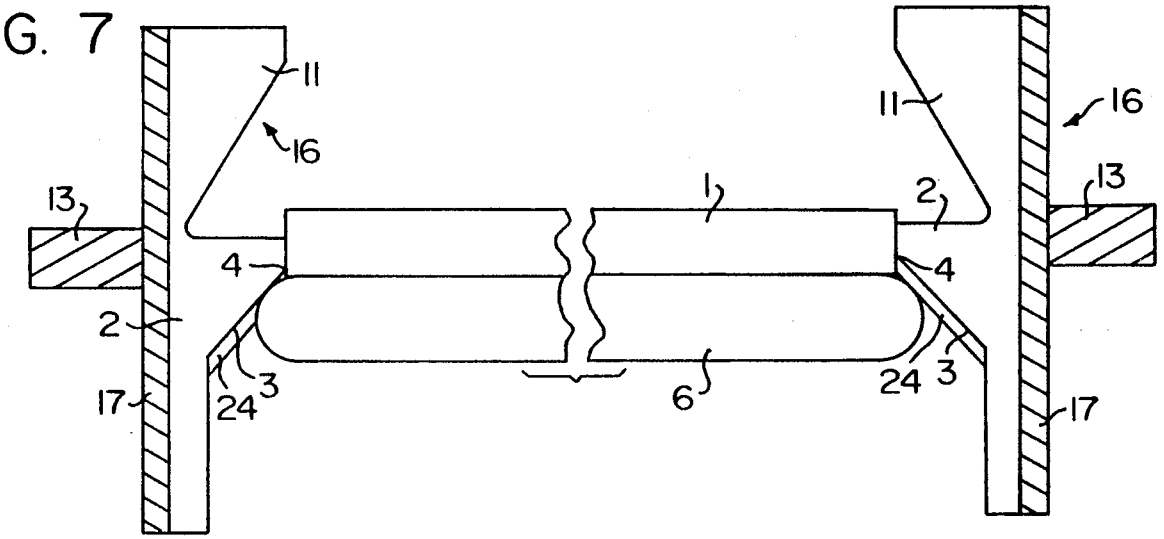
Figure 8:
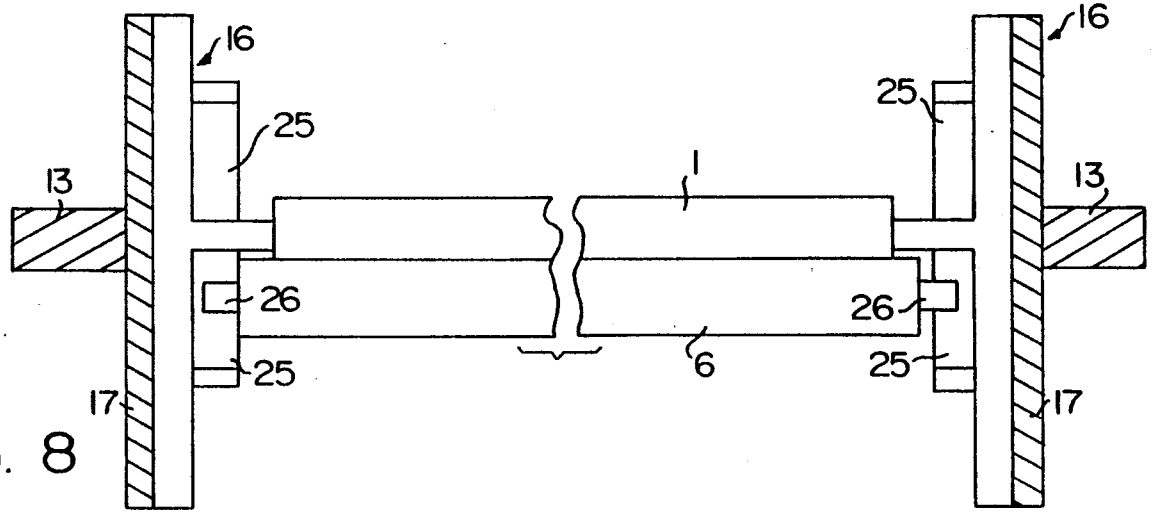
Figure 6:
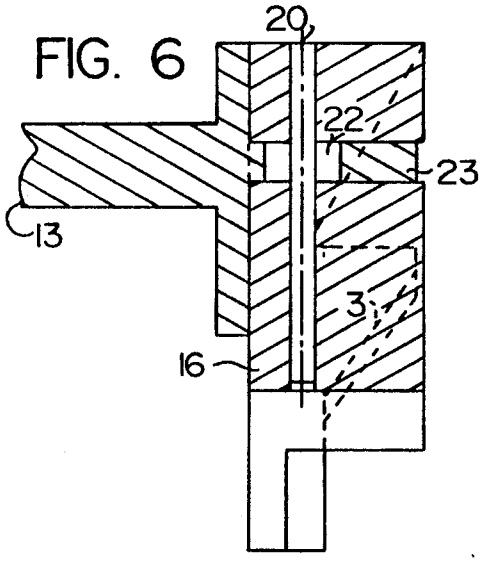

Further details of the invention are described with reference to the drawing in which the left-hand side of FIG. 1 shows a first embodiment of the invention while the right-hand side shows a second embodiment, taken along section line I—I in FIG. 5, FIGS. 2 and 3 illustrate the mode of operation of an apparatus corresponding to the left-hand side of FIG. 1, FIG. 4 is a view in vertical section in the longitudinal direction of the web of material, FIG. 5 is a front view of the embodiment shown in the left-hand side of FIG. 1 and FIG. 6 is a view in section taken along line VI—VI in FIG. 4, FIG. 7 is a section through another embodiment of the invention corresponding to FIG. 1, FIG. 8 is a section through another embodiment of the invention corresponding to FIG. 1.

The apparatus according to the invention as shown in FIG. 1 has left-hand and right-hand lateral boundary structures 16 and 16' which are of a symmetrical configuration and which either both correspond to the construction shown at the left-hand side in FIG. 1 or, as a possible alternative form, they correspond to the construction shown at the right-hand side of FIG. 1. Provided in the lateral boundary structure 16 shown at the left in FIG. 1 are two guide members 2 and 11 for a roller 6 which extends transversely with respect to the web of material, the guide members having contact surfaces 3 and 7 for the roller 6. The guide members 2 and 11 which comprise plastics material carry a plate 17 of magnetisable material on their outward side and are adjustable in respect of height in a guide 13, the function of which can be seen in particular from FIGS. 5 and 6. An essential aspect in regard to the invention is the bar 1 of rubber-elastic material, the front side 18 of which, in the non-loaded condition as shown in FIG. 1, extends at a spacing in front of the rearward end 4, 4' of the contact surfaces 3, 3' for a roller 6 which is arranged in front of the bar 1. Likewise the rear side 9 of the sealing bar 1 extends behind the front end 10, 10' of the contact surfaces 7, 7' which come into operation when the roller 6 is arranged behind the bar (see the broken-line view in FIG. 4).

In the alternative form of the invention shown on the left-hand side in FIG. 1, the contact surfaces 7 and a symmetrical surface (not shown) on the right-hand side, for the roller arranged behind the sealing bar 1, extend parallel to the front contact surfaces 3 and 3'. The alternative embodiment shown at the right has at both sides only one guide member 2' carrying the converging contact surfaces 3' and 7'. That alternative embodiment is an attractive proposition when the roller 6 has a tendency to be displaced inclinedly forwardly opposite to the direction of movement 21 of the web of material.

The mode of operation of the apparatus according to the invention can be seen in diagrammatic form in FIGS. 2 and 3. It will be seen from FIG. 2 that, under the pressure of the roller 6, the resilient bar is pushed back with its front side 8 until it reaches the end of the contact surfaces 3 and 3'. If now the roller 6 moves into the inclined position shown in FIG. 3, the contact surface 3 ensures that the front end of the roller is subjected to a force which positions it in normal relationship to the web of material again. The essential consideration in regard to the invention is that in that case the roller 6 does not lose contact with the bar 1. That is achieved by the bar 1 being displaceable in the direction of movement relative to the guide members 2 and 2' and also comprising twistable, rubber-elastic material.

FIG. 4 shows the apparatus according to the invention when applied to a printing arrangement with which a web of material 5 which is fixed on a printing blanket 19 is subjected to treatment by means of a round stencil 18. In this case the bar 1 is held in a clamping profile member 15 which is connected to the ink pipe 14 which serves to supply the application material. To increase its flexibility, the bar 1 is provided with a longitudinal groove 12.

As can be seen in particular from FIGS. 5 and 6, the lateral boundary structure 16 which carries the guide members 2 and 11 is mounted vertically slidably with a lateral guide 13. The lateral boundary structure 16 is prevented from dropping out in that arrangement by a pin 20 which passes through an opening 22 in a guide plate 23 which is guided in an opening in the lateral boundary structure 16. A magnetic beam is provided beneath the printing blanket 19 to provide for the pressing action of the roller 6. The magnetic beam acts at the same time on the plate 17 of magnetisable material which is mounted externally on the boundary structure 16. The vertical mobility of the boundary structure 16, in conjunction with the rounded-off configuration of the ends of the roller 6, results in an optimum sealing effect which prevents application material from passing into the space behind the roller 6. For the same purpose the guide members 2 may have a lower edge 24 as shown in FIG. 7 which projects towards the end of the roller and which, by virtue of its approximately triangular cross-section, fills up the space beneath the end of the roller.

The invention is not limited to apparatuses in which the boundary plates 16 have inclinedly extending contact surfaces 3 for the roller 6. For example it is also possible to envisage a construction as shown in FIG. 8 in which the lateral boundary plates 16 are provided with boundary surfaces which are disposed normal to the axis of the roller. A third function of the boundary plates 16 can be seen in that construction, namely the possibility of removing the roller 6 which terminates with trunnions 26, together with the ink pipe 14, from the round stencil 18. For that purpose the boundary plates 16 are provided with edge bars 25 which extend substantially horizontally but which are bent up at the outer edge and which engage under the trunnions 26 so that there is no contact between the trunnions 26 and the edge bars 25 during operation of the arrangement. The arrangement in accordance with the invention of the magnetisable inserts 17 which guarantee the precise positioning of the boundary plates 16 is particulary important in that connection.

I claim:

1. A squeegee device for applying a substance to a web of material, comprising a squeegee slidably guided in a direction normal to the web and lateral boundary plates for the squeegee, said boundary plates being provided with inserts of magnetizable material which can be attracted by a magnet arranged beneath the web of material.

2. A device according to claim 1 comprising a roller which, in the operation of applying the substance, performs a rolling movement relative to the web, the ends of said roller having trunnions of reduced diameter relative to the diameter of the roller, said boundary plates having edge bars in the form of bent over plate members engaging under the trunnions.

* * * * *